US009753392B2

(12) United States Patent
Konishi

(10) Patent No.: US 9,753,392 B2
(45) Date of Patent: Sep. 5, 2017

(54) IMAGE CARRIER UNIT HAVING AN IMAGE CARRIER AND A CHARGING DEVICE FOR CHARGING THE IMAGE CARRIER INTEGRATED INTO A UNIT AND IMAGE FORMING APPARATUS INCLUDING SAME

(71) Applicant: KYOCERA Document Solutions Inc., Osaka (JP)

(72) Inventor: Hirohito Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/209,341

(22) Filed: Jul. 13, 2016

(65) Prior Publication Data

US 2017/0031257 A1 Feb. 2, 2017

(30) Foreign Application Priority Data

Jul. 28, 2015 (JP) ..... 2015-148208

(51) Int. Cl.
*G03G 15/02* (2006.01)
*G03G 21/18* (2006.01)
*G03G 21/08* (2006.01)

(52) U.S. Cl.
CPC ..... *G03G 15/0258* (2013.01); *G03G 21/1832* (2013.01); *G03G 21/08* (2013.01)

(58) Field of Classification Search
CPC ..... G03G 2215/0448; G03G 15/0225; G03G 15/0258
See application file for complete search history.

(56) References Cited

U.S. PATENT DOCUMENTS 6,249,660 B1 * 6/2001 Matsushita ..... G03G 21/1814 399/115

FOREIGN PATENT DOCUMENTS

JP 9-90833 A 4/1997
JP 2005321698 A * 11/2005

OTHER PUBLICATIONS

JP_2005321698_A_T Machine Translation Japan, Komai, 2005.*

* cited by examiner

*Primary Examiner* — Victor Verbitsky
(74) *Attorney, Agent, or Firm* — Stein IP, LLC

(57) ABSTRACT

An image carrier unit includes an image carrier, a charging device, and a unit housing. The charging device is attachably/detachably held in the unit housing, and electrically charges a surface of the image carrier. The unit housing integrally holds the image carrier and the charging device. The unit housing includes a light shielding member disposed at a first position at which the light shielding member blocks charge elimination light shone onto the image carrier from a charge elimination device provided on a side of the image forming apparatus such that the charge elimination light does not reach the charging device, the first position overlapping with an attachment-detachment path of the charging device. When detaching the charging device from the unit housing, the light shielding member moves from the first position to a second position retracted from the attachment-detachment path of the charging device.

8 Claims, 4 Drawing Sheets

IMAGE CARRIER UNIT HAVING AN IMAGE CARRIER AND A CHARGING DEVICE FOR CHARGING THE IMAGE CARRIER INTEGRATED INTO A UNIT AND IMAGE FORMING APPARATUS INCLUDING SAME

INCORPORATION BY REFERENCE

This application is based upon and claims the benefit of priority from the corresponding Japanese Patent Application No. 2015-148208 filed on Jul. 28, 2015, the entire contents of which are incorporated herein by reference.

BACKGROUND

The present disclosure relates to an image forming apparatus, such as, a copier, a printer, a facsimile machine, or a multifunction peripheral equipped with these items, that employs an electrophotographic method and in particular, to an image carrier unit constituted of an image carrier and a charging device that electrically charges the image carrier, and an image forming apparatus including the same.

Conventionally, in image forming apparatuses using an electrophotography process, an electrostatic latent image is formed on an image carrier (a photosensitive drum) a surface of which is electrically charged uniformly, and a toner image corresponding to the electrostatic latent image is formed on the image carrier by using a developing unit. Then, typically by using a transfer member such as a transfer roller that forms a transfer nip with the photosensitive drum, the toner image formed on the image carrier is transferred onto a sheet conveyed to the transfer nip, and thereafter, the toner image is fixed on the sheet by causing the sheet to pass through a fixing unit.

Such an image forming apparatus is provided with a charge elimination device for removing residual charge remaining on the image carrier in preparation for formation of a next electrostatic latent image after the toner image formed on the image carrier is transferred onto the sheet.

For example, there has been known an image forming apparatus including a transfer charging device that transfers developer supplied by a developing device to a photosensitive member onto a sheet and electrically charges the photosensitive member to an electric potential of a polarity opposite a polarity of an electric potential to which a charging device electrically charges the photosensitive member, and charge elimination means that irradiates the photosensitive member with light of a predetermined wavelength to thereby remove charge generated by the transfer charging device.

SUMMARY

According to one aspect of the present disclosure, an image carrier unit includes an image carrier, a charging device, and a unit housing, and the image carrier unit is attachable and detachable to and from an image forming apparatus. On the image carrier, an electrostatic latent image is formed. The charging device electrically charges a surface of the image carrier. The unit housing integrally holds the image carrier and the charging device. The charging device is held in the unit housing in an attachable and detachable manner. The unit housing is provided with a light shielding member that is disposed at a first position at which the light shielding member blocks charge elimination light shone onto the image carrier from a charge elimination device provided on the image forming apparatus side such that the charge elimination light does not reach the charging device, the first position overlapping with an attachment-detachment path of the charging device. Along with operation of detaching the charging device from the unit housing, the light shielding member moves from the first position to a second position retracted from the attachment-detachment path of the charging device.

Further features and specific advantages of the present disclosure will become apparent from the following descriptions of preferred embodiments.

DETAILED DESCRIPTION

Figure 1:
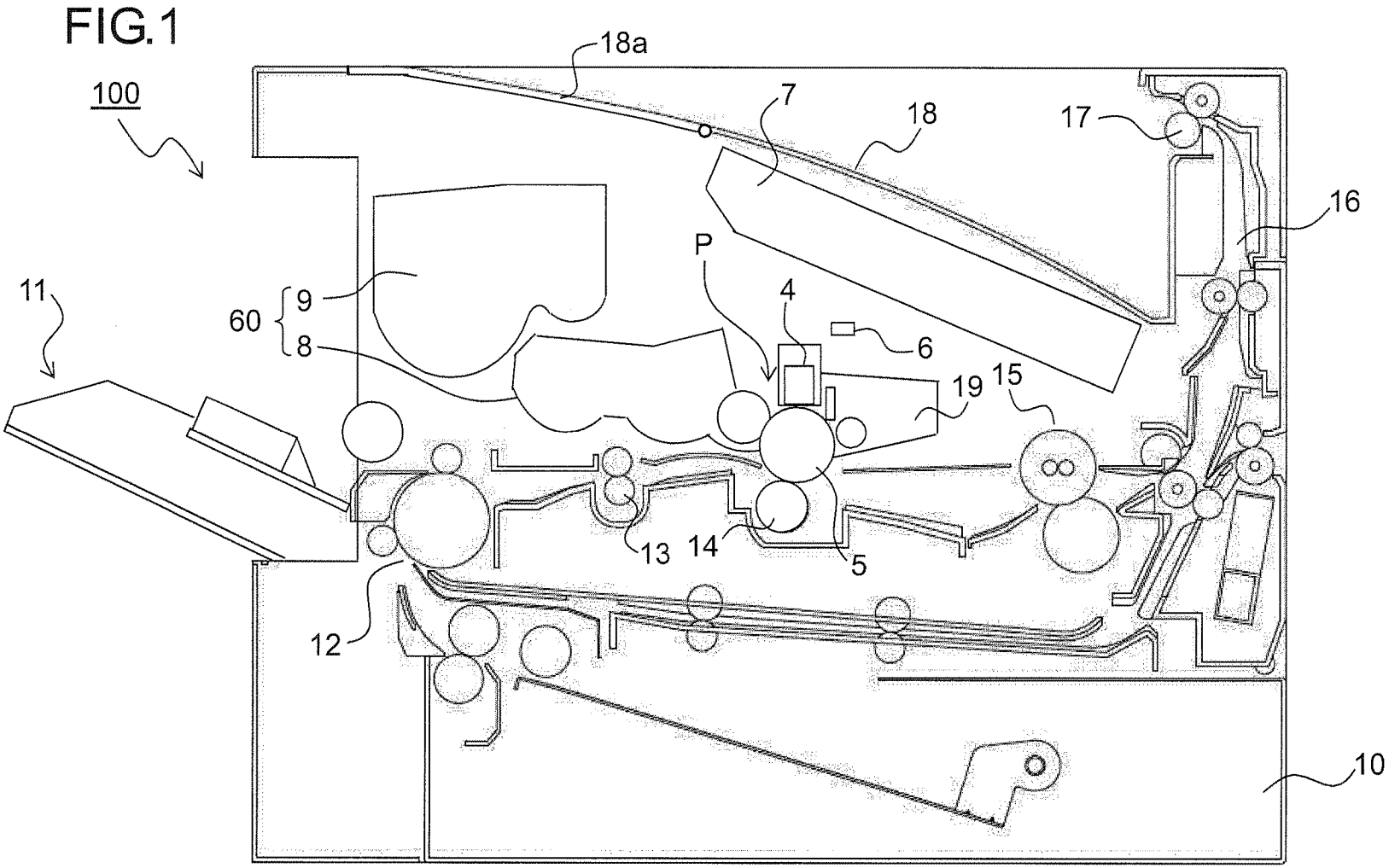
FIG. 1 is a side sectional view showing an internal structure of an image forming apparatus including a drum unit of the present disclosure.

Hereinafter, embodiments of the present disclosure will be described with reference to the accompanying drawings. FIG. 1 is a side sectional view showing an internal structure of an image forming apparatus 100 including a drum unit 30 of the present disclosure. Inside the image forming apparatus (here, a monochrome printer) 100, there is arranged an image forming portion P that forms a monochrome image through charging, exposure, developing, and transfer steps. In the image forming portion P, along a rotation direction of a photosensitive drum 5 (a clockwise direction in FIG. 1), there are arranged a charging device 4, an exposure unit (a laser scanning unit or the like) 7, a developing device 8, a transfer roller 14, a cleaning device 19, and a charge elimination device 6.

When performing an image forming operation, the photosensitive drum 5, which rotates in the clockwise direction, is electrically charged uniformly by the charging device 4. Next, an electrostatic latent image is formed on the photosensitive drum 5 by means of a laser beam emitted from the exposure unit 7 based on document image data. Then, a developing device 8 causes developer (hereinafter referred to as toner) to adhere to the electrostatic latent image to form a toner image.

Toner is supplied to the developing device 8 from a toner container 9. Here, the image data is transmitted from a host device such as a personal computer (not shown). The charge elimination device 6 that removes residual electric charge remaining on a surface of the photosensitive drum 5 is provided on a downstream side of the cleaning device 19 with respect to a rotation direction of the photosensitive drum 5.

The charging device 4, the photosensitive drum 5, and the cleaning device 19 together form a unit, and the developing device 8 and the toner container 9 together form a unit. Hereinafter, the unit composed of the charging device 4, the photosensitive drum 5, and the cleaning device 19 will be referred to as a drum unit 30 (refer to FIG. 2). Hereinafter, the unit composed of the developing device 8 and the toner container 9 will be referred to as a developing unit 60. The drum unit 30 and the developing unit 60 are each attachable and detachable to and from a main body of the image forming apparatus 100.

Toward the photosensitive drum 5 on which the toner image has been formed in the above-described manner, a sheet is conveyed from a sheet feeding cassette 10 or a manual sheet feeding device 11 via a sheet conveyance path 12 and a registration roller pair 13. Then, the toner image formed on the surface of the photosensitive drum 5 is transferred onto the sheet by the transfer roller 14 (an image transfer portion). The sheet onto which the toner image has been transferred is separated from the photosensitive drum 5 and conveyed to a fixing device 15, where the toner image is fixed on the sheet. The sheet that has passed through the fixing device 15 is conveyed via a sheet conveyance path 16 to an upper part of the apparatus, to be then discharged by the discharge roller pair 17 onto a discharge tray 18.

At an upper surface of the image forming apparatus 100, there is provided an openable cover 18*a* as a part of the discharge tray 18. In a state where the openable cover 18*a* is opened, the drum unit 30 and the developing unit 60 are inserted into, or drawn out of, the main body of the image forming apparatus 100.

Figure 2:
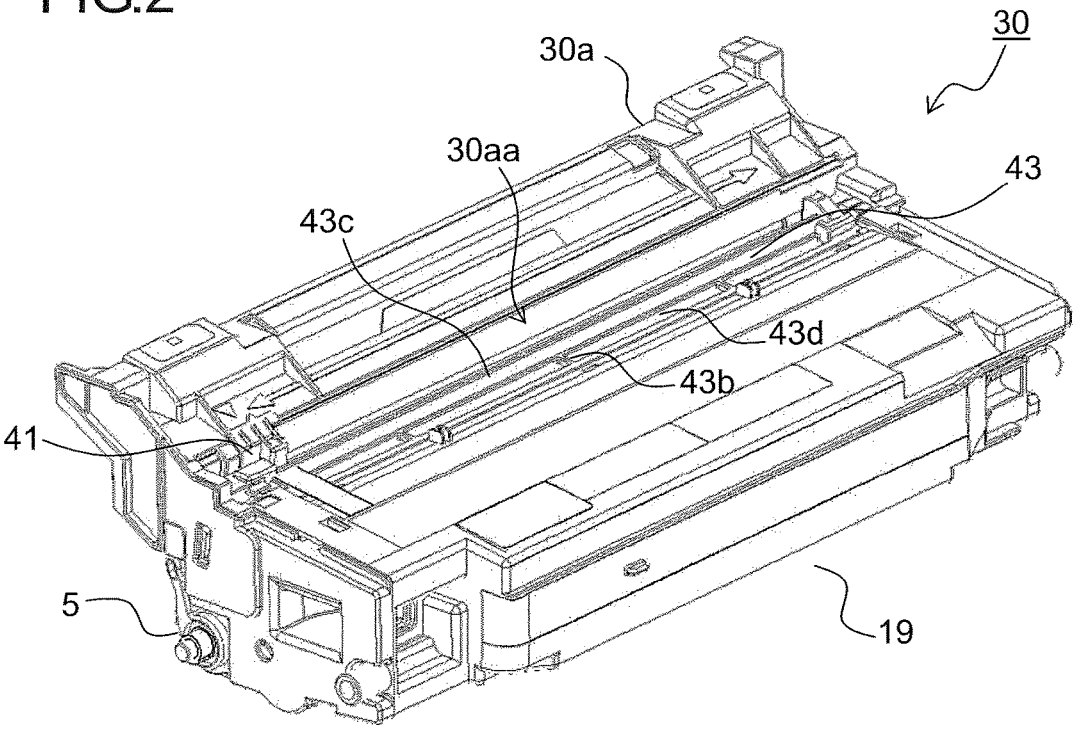
FIG. 2 is an external perspective view of a drum unit according to an embodiment of the present disclosure.
Figure 3:
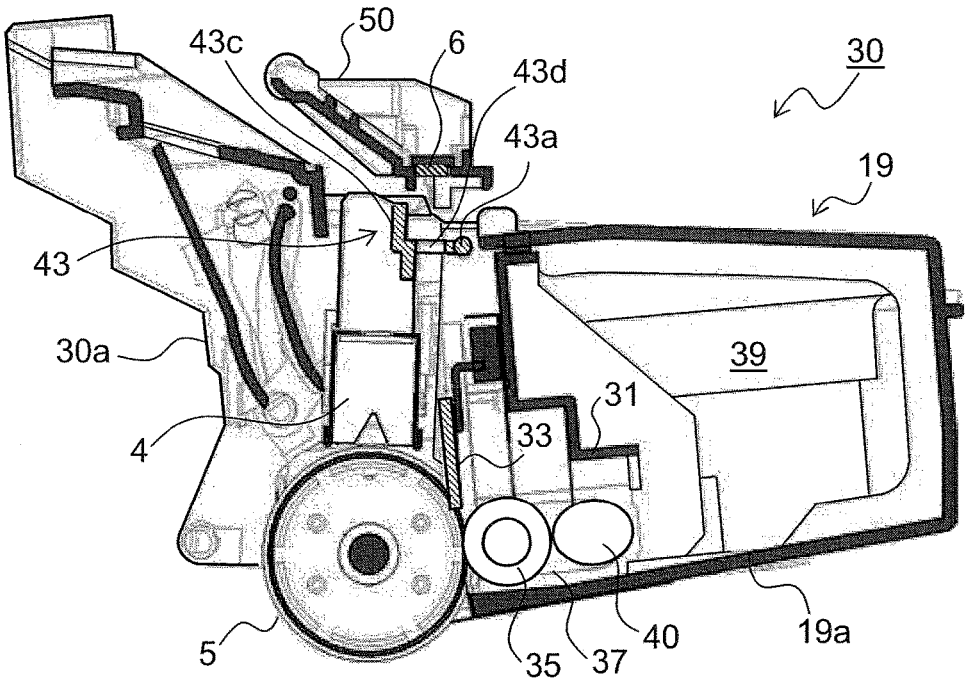
FIG. 3 is a side sectional view of the drum unit of the present embodiment.
Figure 4:
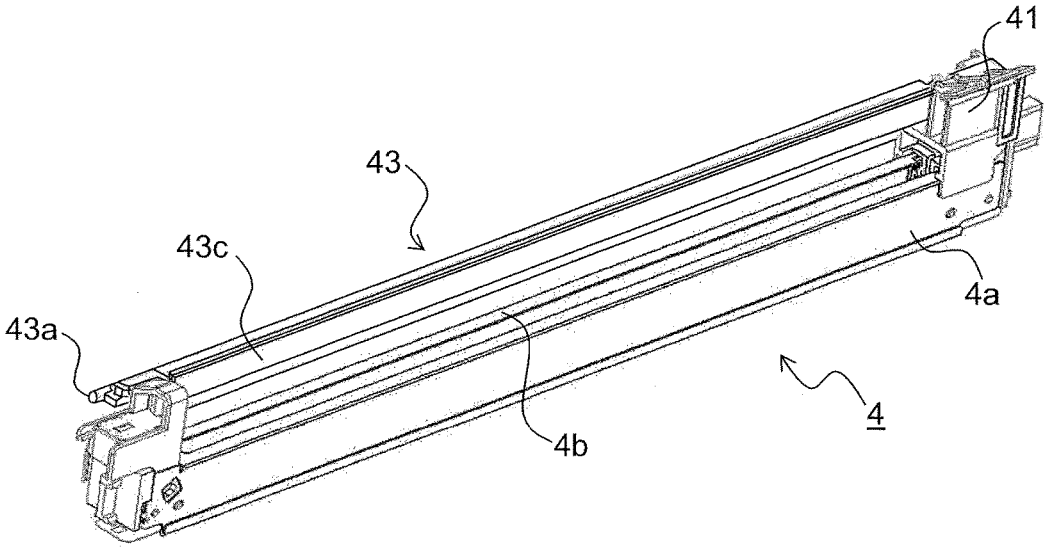
FIG. 4 is an external perspective view of a charging device included in the drum unit.

FIG. 2 is an external perspective view of the drum unit 30 according to an embodiment of the present disclosure and mounted in the image forming apparatus 100, FIG. 3 is a side sectional view of the drum unit 30, and FIG. 4 is a perspective view of the charging device 4 included in the drum unit 30. For ease of description, FIG. 3 also illustrates the charge elimination device 6 and a support frame 50 that holds the charge elimination device 6, the charge elimination device 6 and the support frame 50 being disposed on a main-body side of the image forming apparatus 100. FIG. 4 shows a state where the charging device 4 is viewed from a side (a left side in FIG. 3) opposite to a light shielding member 43.

The drum unit 30 integrally holds the photosensitive drum 5, the charging device 4, and the cleaning device 19 by means of a unit housing 30*a*. The cleaning device 19 includes a housing 19*a* that has an opening portion facing the photosensitive drum 5, and the housing 19*a* forms a part of the unit housing 30*a*. An interior of the housing 19*a* is divided into two parts by a partition wall 31. On a side of the partition wall 31 closer to the photosensitive drum 5, there is provided a toner scraping portion 37 where a cleaning blade 33 and a cleaning roller 35 are disposed.

On a side opposite from the toner scraping portion 37 with respect to the partition wall 31, there is provided a waste toner storage portion 39 for storing waste toner scraped off from the photosensitive drum 5 by the cleaning blade 33 and the cleaning roller 35. The toner scraping portion 37 and the waste toner storage portion 39 communicate with each other via a communication portion under the partition wall 31, and a sweep roller 40 is provided that sends waste toner from the toner scraping portion 37 to the communication portion.

As shown in FIG. 4, the charging device 4 is arranged so as to face the photosensitive drum 5 over a substantially entire area in a longitudinal direction of the photosensitive drum 5 (a direction perpendicular to the sheet on which FIG. 3 is drawn). The charging device 4 is a scorotron charging device having a shield member (a case) 4*a* that is U-shaped in section and has an open portion on a side thereof facing the surface of the photosensitive drum 5, a corona wire 4*b* to which a high voltage is applied, and a grid (not shown) provided at the open portion of the shield member 4*a*. The charging device 4 electrically charges the surface of photosensitive drum 5 to a predetermined positive electric potential (the same polarity as the toner) via the grid by means of corona discharge from the corona wire 4*b*. The charging device 4 is attachable and detachable to and from the drum unit 30 for maintenance and replacement. The charging device 4 is detached from the unit housing 30*a* by being drawn out through an opening 30*aa* formed in an upper part of the unit housing 30*a*, and is attached to the unit housing 30*a* by being inserted through the opening 30*aa*.

With the charging device 4, which is a scorotron discharging device, components of air are oxidized by action of ozone generated by the corona discharge, as a result of which ionic products, such as $NO_x$ and $SO_x$, are generated. These ionic products together with dust around them tend to adhere to the corona wire 4*b* and the grid. To cope with this, at one end of the charging device 4, there is fitted a cleaning member 41 for removing from the corona wire 4*b* ionic products which has adhered thereto.

The cleaning member 41 includes a case 41*a* made of resin, and a cleaning portion 41*b* provided so as to face the corona wire 4*b* below the case 41*a* (refer to FIG. 6 for the case 41*a* and the cleaning portion 41*b*). To the cleaning portion 41*b*, there is fitted a wet sponge soaked with water or alcohol. By reciprocating the cleaning member 41 in a longitudinal direction of the charging device 4, the corona wire 4*b* is rubbed by the wet sponge of the cleaning portion 41*b*, whereby adherent substances on a surface of the corona wire 4*b* are removed.

The unit housing 30*a* is provided with the light shielding member 43 that blocks light (charge elimination light) emitted from the charge elimination device 6. The light shielding member 43 is a member that is substantially T-shaped in section, and is composed of a swing support shaft 43*a* that is formed at both end parts of the light shielding member 43 in its longitudinal direction and swingably supported by the unit housing 30*a*, an arm portion 43*b* that is coupled to a swing support shaft 43*a*, and a light shielding plate 43*c* that is orthogonal to the arm portion 43*b*. The arm portion 43*b* includes a window portion 43*d* formed therein.

FIG. 3 and FIG. 4 show a state where the drum unit 30 is installed in the main body of the image forming apparatus 100. In this state, the light shielding member 43 is disposed at a position where the light shielding member 43 blocks the charge elimination light emitted from the charge elimination device 6 such that the charge elimination light does not reach the charging device 4 (hereinafter, this position will be referred to as the first position). The charge elimination light emitted from the charge elimination device 6 passes through the window portion 43*d* of the light shielding member 43, and further passes through a gap between the charging device 4 and the cleaning device 19, and then reaches the surface of the photosensitive drum 5.

Figure 5:
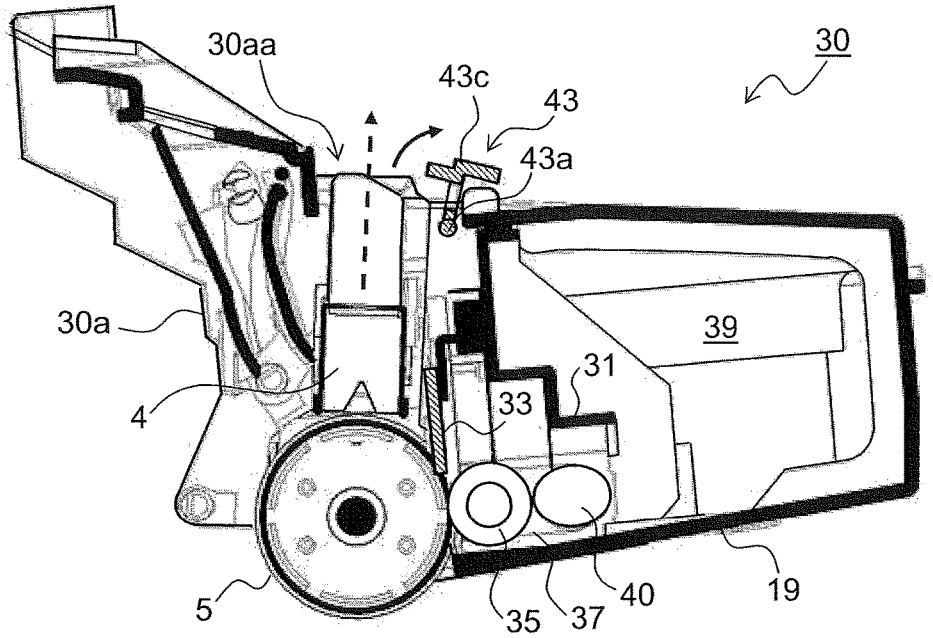
FIG. 5 is a side sectional view of the drum unit, and shows how a light shielding member operates when the charging device is detached.

FIG. 5 is a side sectional view of the drum unit 30, and shows how the light shielding member 43 operates when the charging device 4 is detached. In a state where the drum unit 30 has been drawn out of the main body of the image forming apparatus 100, as shown in FIG. 3, the light shielding member 43 is disposed at the first position, and the light shielding plate 43*c* of the light shielding member 43 is disposed on the attachment-detachment path of the charging device 4.

When the charging device 4 is pulled upward (a direction indicated by a broken line arrow in FIG. 5) through the opening 30*aa* of the unit housing 30*a*, the shield member 4*a* of the charging device 4 comes into contact with the light shielding plate 43*c*, to cause the light shielding member 43 to swing about the swing support shaft 43*a* in the clockwise direction in FIG. 5. As a result, as shown in FIG. 5, the light shielding member 43 is disposed in a position that is retracted from the attachment-detachment path of the charging device 4 (hereinafter, this position will be referred to as the second position).

According to the configuration of the present embodiment, the light shielding member 43 disposed at the first position is automatically moved to the second position by the operation of pulling out the charging device 4. Thus, disposing the light shielding member 43 at a position overlapping with the attachment-detachment path of the charging device 4 does not interfere with the operation of detaching the charging device 4. This helps increase the degree of freedom in disposition of the light shielding member 43, and makes it possible to dispose the light shielding member 43 at a position where a high light shielding effect can be achieved, without any restrictions from the attachment-detachment path of the charging device 4.

After the charging device 4 is detached, the light shielding member 43 is disposed at the second position. This makes it possible to attach the charging device 4 back to the drum unit 30 by inserting the charging device 4 through the opening 30*aa* without touching the light shielding member 43.

Figure 6:
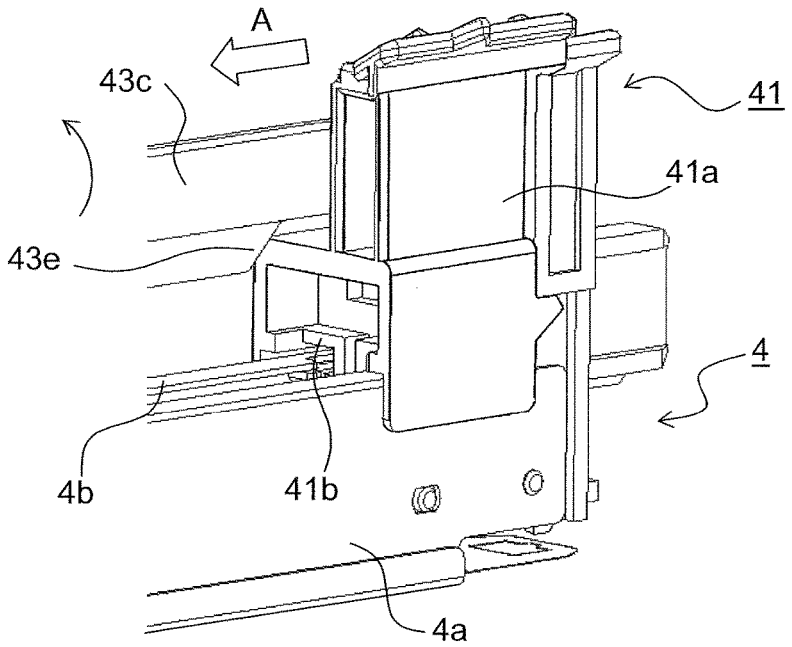
FIG. 6 is an enlarged perspective view of and around a cleaning member of the charging device.

FIG. 6 is an enlarged perspective view of and around the cleaning member 41 of the charging device 4. In a case where cleaning is performed only with respect to the corona wire 4*b* when the charging device 4 is attached to the drum unit 30, the cleaning member 41 is moved from one end (a reference position) to the other end of the charging device 4 (in a direction indicated by an arrow A). At this time, the light shielding member 43 is disposed at the first position, and as shown in FIG. 6, the light shielding plate 43*c* of the light shielding member 43 is disposed on a moving path of the cleaning member 41.

Thus, as shown in FIG. 6, a slope 43*e* is formed in the light shielding plate 43*c* at a part thereof that abuts on the cleaning member 41. With this configuration, the light shielding plate 43*c* moves along the slope 43*e* onto the case 41*a* of the cleaning member 41, and thereby the light shielding member 43 is automatically caused to swing to the second position. This allows the cleaning member 41 to move to the other end side without having its way blocked by the light shielding member 43.

Although not illustrated here, the light shielding plate 43*c* is on the case 41*a* of the charging member 41 at the other end side of the charging device 4, and thus the cleaning member 41 can be moved to the one end side as it is.

Figure 7:
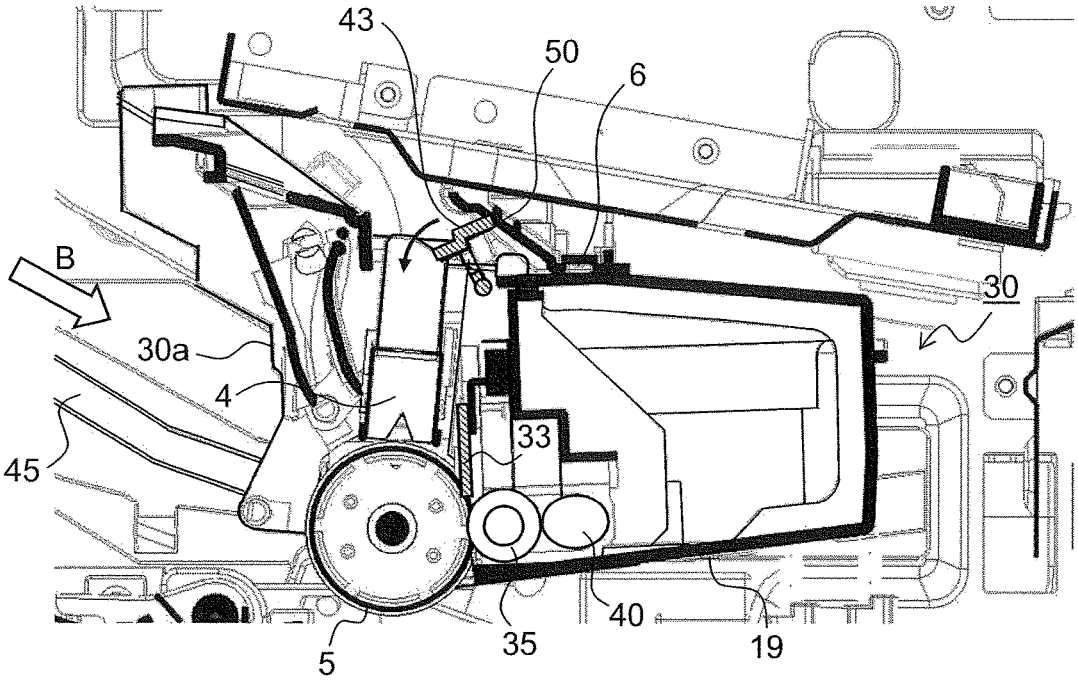
FIG. 7 is a side sectional view of and around the drum unit, and shows how the light shielding member operates when the drum unit is inserted into a main body of the image forming apparatus.

FIG. 7 is a side sectional view of and around the drum unit 30, and shows how the light shielding member 43 operates when the drum unit 30 is inserted into the main body of the image forming apparatus 100. As described above, in the state where the charging device 4 is inserted in the unit housing 30*a*, the light shielding member 43 is disposed at the second position. In the course of inserting the drum unit 30 in an attachment direction (a direction indicated by an arrow B) along a guide groove 45 formed on the side of the main body of the image forming apparatus 100, the light shielding plate 43*c* of the light shielding member 43 touches the support frame 50 before the drum unit 30 is inserted to a predetermined position in the main body of the image forming apparatus 100. As a result, the light shielding member 43 swings about the swing support shaft 43*a* in the counterclockwise direction in FIG. 7, and the light shielding member 43 moves to the first position.

Then, when the drum unit 30 is inserted to the predetermined position, a center shaft of the photosensitive drum 5 is disposed at a positioning portion (not shown) formed at a terminal end part of the guide groove 45, and the photosensitive drum 5 and the transfer roller 14 (refer to FIG. 1) contact each other to form a transfer nip portion. Thus, since the light shielding member 43 disposed at the second position is automatically moved to the first position by the operation of attaching the drum unit 30 to the main body of the image forming apparatus 100, the need is eliminated of performing operation of moving the light shielding member 43 from the second position back to the first position when attaching the drum unit 30, and also the risk is eliminated of forgetting to move the light shielding member 43 back to the first position.

It should be understood that the present disclosure is not limited to the above embodiments, and various modifications are possible within the scope of the present disclosure. For example, the above-discussed embodiments have been described dealing with the charging device 4 that is provided with the cleaning member 41 that removes adherent substances on the surface of the corona wire 4*b*, but the cleaning member 41 may be configured to remove adherent substances on the grid. In that case, too, with the same configuration as in the present embodiment, it is possible to prevent mutual interference between the cleaning member 41 and the light shielding member 43.

Further, the above-discussed embodiments have been described dealing with a case where the scorotron charging device 4 provided with the corona wire 4*b* and the grid is used, but the present disclosure is applicable in the same manner to a case where a contact charging device provided with a charging roller contacting the photosensitive drum 5 is used. Note that the cleaning member 41 is not necessary in a contact charging device, which does not have a corona wire 4*b* or a grid, and thus there is no need of providing the mechanism of retracting the light shielding member 43 by the movement of the cleaning member 41.

Further, the present disclosure is not limited to the monochrome printer as shown in FIG. 1, but is certainly applicable to other types of image forming apparatuses, such as color printers, monochrome and color copiers, digital multifunction peripherals, and facsimile machines, which include the drum unit 30.

The present disclosure is applicable to an image forming apparatus including an image carrier unit. Use of the present disclosure makes it possible to provide an image forming apparatus capable of separating an image carrier and a transfer member from each other with a simple configuration, and improving detachability of the image carrier unit from the image forming apparatus.

What is claimed is:

1. An image carrier unit attachable to and detachable from an image forming apparatus, the image carrier unit comprising:

an image carrier on which an electrostatic latent image is formed;

a charging device comprising a grid, a shield member, and a corona wire, that electrically charges a surface of the image carrier;

the charging device is attachable and detachable to and from a unit housing;

the unit housing holding both the image carrier and the charging device; and a light shielding member that is provided in the unit housing and disposed selectively either at a first position at which the light shielding member blocks charge elimination light shining onto the image carrier from a charge elimination device provided on the image forming apparatus side and prevents the charge elimination light from reaching the charging device, the first position overlapping with an attachment-detachment path of the charging device, or at a second position at which the light shielding member is retracted from the attachment-detachment path of the charging device, wherein as the charging device is detached from the unit housing, the light shielding member moves from the first position to the second position.

2. The image carrier unit according to claim 1, wherein the light shielding member is held at the second position after the charging device is detached from the unit housing.

3. The image carrier unit according to claim 1, wherein the light shielding member moves from the second position to the first position along with operation of attaching the image carrier unit to the image forming apparatus.

4. An image carrier unit attachable to and detachable from an image forming apparatus, the image carrier unit comprising:

an image carrier on which an electrostatic latent image is formed:

a charging device that electrically charges a surface of the image carrier;

a unit housing that holds both the image carrier and the charging device; and a light shielding member that is provided in the unit housing and disposed selectively either at a first position at which the light shielding member blocks charge elimination light shining onto the image carrier from a charge elimination device provided on the image forming apparatus side and prevents the charge elimination light from reaching the charging device, the first position overlapping with an attachment-detachment path of the charging device, or at a second position at which the light shielding member is retracted from the attachment-detachment path of the charging device, wherein the charging device is attachable and detachable to and from the unit housing, and as the charging device is detached from the unit housing the light shielding member moves from the first position to the second position, the image carrier unit includes a cleaning member that reciprocates along a longitudinal direction of the charging device, and when the light shielding member is disposed at the first position, the light shielding member overlaps with a moving path of the cleaning member, and along as the cleaning member moves from a reference position at one end side of the charging device to another end side of the charging device, the light shielding member moves from the first position to the second position.

5. The image carrier unit according to claim 4, wherein the light shielding member has a slope formed therein at a position that comes into contact with the cleaning member when the cleaning member moves from the reference position to the other end side, and along movement of the cleaning member, by the light shielding member moving along the slope onto the cleaning member, the light shielding member moves from the first position to the second position.

6. An image carrier unit attachable to and detachable from an image forming apparatus, the image carrier unit comprising:

an image carrier on which an electrostatic latent image is formed;

a charging device that electrically charges a surface of the image carrier;

a unit housing that holds both the image carrier and the charging device; and a light shielding member that is provided in the unit housing and disposed selectively either at a first position at which the light shielding member blocks charge elimination light shining onto the image carrier from a charge elimination device provided on the image forming apparatus side and prevents the charge elimination light from reaching the charging device, the first position overlapping with an attachment-detachment path of the charging device, or at a second position at which the light shielding member is retracted from the attachment-detachment path of the charging device, wherein the charging device is attachable and detachable to and from the unit housing, and as the charging device is detached from the unit housing, the light shielding member moves from the first position to the second position, the light shielding member is a member that is substantially T shaped in section, and is composed of a swing support shaft that is swingably supported by the unit housing, an arm portion that is coupled to the swing support shaft, and a light shielding plate that is orthogonal to the arm portion, and the arm portion includes a window portion formed therein through which the charge elimination light passes in a state where the light shielding member is disposed in the first position.

7. An image forming apparatus comprising the image carrier unit according to claim 1.

8. The image carrier unit according to claim 6, wherein as the charging device is detached from the unit housing, the charging device comes into contact with the light shielding member and causes the light shielding member to move from the first position to the second position.

* * * * *